United States Patent [19]

Shuster et al.

[11] 4,290,864

[45] Sep. 22, 1981

[54] CHROMIC ACID PRODUCTION PROCESS USING A THREE-COMPARTMENT CELL

[75] Inventors: Nicholas Shuster, Perry; Andrew D. Babinsky, Chagrin Falls; William E. Kidon, Chardon, all of Ohio

[73] Assignee: Diamond Shamrock Corporation, Dallas, Tex.

[21] Appl. No.: 147,210

[22] Filed: May 6, 1980

Related U.S. Application Data

[63] Continuation-in-part of Ser. No. 43,382, May 29, 1979, abandoned.

[51] Int. Cl.[3] ..... C25B 1/00; C25B 1/16; C25B 1/22

[52] U.S. Cl. ..... 204/103; 204/87; 204/97; 204/98

[58] Field of Search ..... 204/87, 89, 97, 103, 204/98

[56] References Cited

U.S. PATENT DOCUMENTS

| | | | |
|---|---|---|---|
| 2,081,787 | 5/1937 | Boss | 204/103 |
| 2,099,658 | 11/1937 | Pearson et al. | 204/103 |
| 3,222,267 | 12/1965 | Tirrell et al. | 204/98 |
| 3,305,463 | 2/1967 | Carlin | 204/89 |
| 3,454,478 | 7/1969 | Carlin | 204/89 |
| 3,481,851 | 12/1969 | Lancy | 204/180 P |

FOREIGN PATENT DOCUMENTS

| | | | |
|---|---|---|---|
| 739447 | 7/1966 | Canada | 204/103 |
| 52-65182 | of 1977 | Japan | 204/103 |

*Primary Examiner*—Howard S. Williams
*Attorney, Agent, or Firm*—John J. Freer

[57] ABSTRACT

Chromic acid production is now simplified in a process using the concentrated dichromate typically available at an intermediate stage when chromic acid is produced from chrome ore. In the process, the dichromate is treated in a three-compartment cell as, for example, after removal of the sulfate or carbonate salt evolved in the overall production process. The dichromate feed enters the center compartment of the three-compartment cell and then flows through a porous diaphragm to the anode compartment of the cell and is electrolyzed at elevated current density. Depleted feed solution may be withdrawn from the center compartment and recirculated for reuse. Concentrated, water-white alkali product is produced in the cathode compartment. The anolyte from the cell, rich in chromic acid, can be concentrated, cooled, and the chromic acid recovered. Liquid removed from chromic acid recovery can be recirculated for subsequent electrolysis, as by combination with the feed. Both alkali product and anolyte chromic acid can be produced at enhanced current efficiency.

34 Claims, 1 Drawing Figure

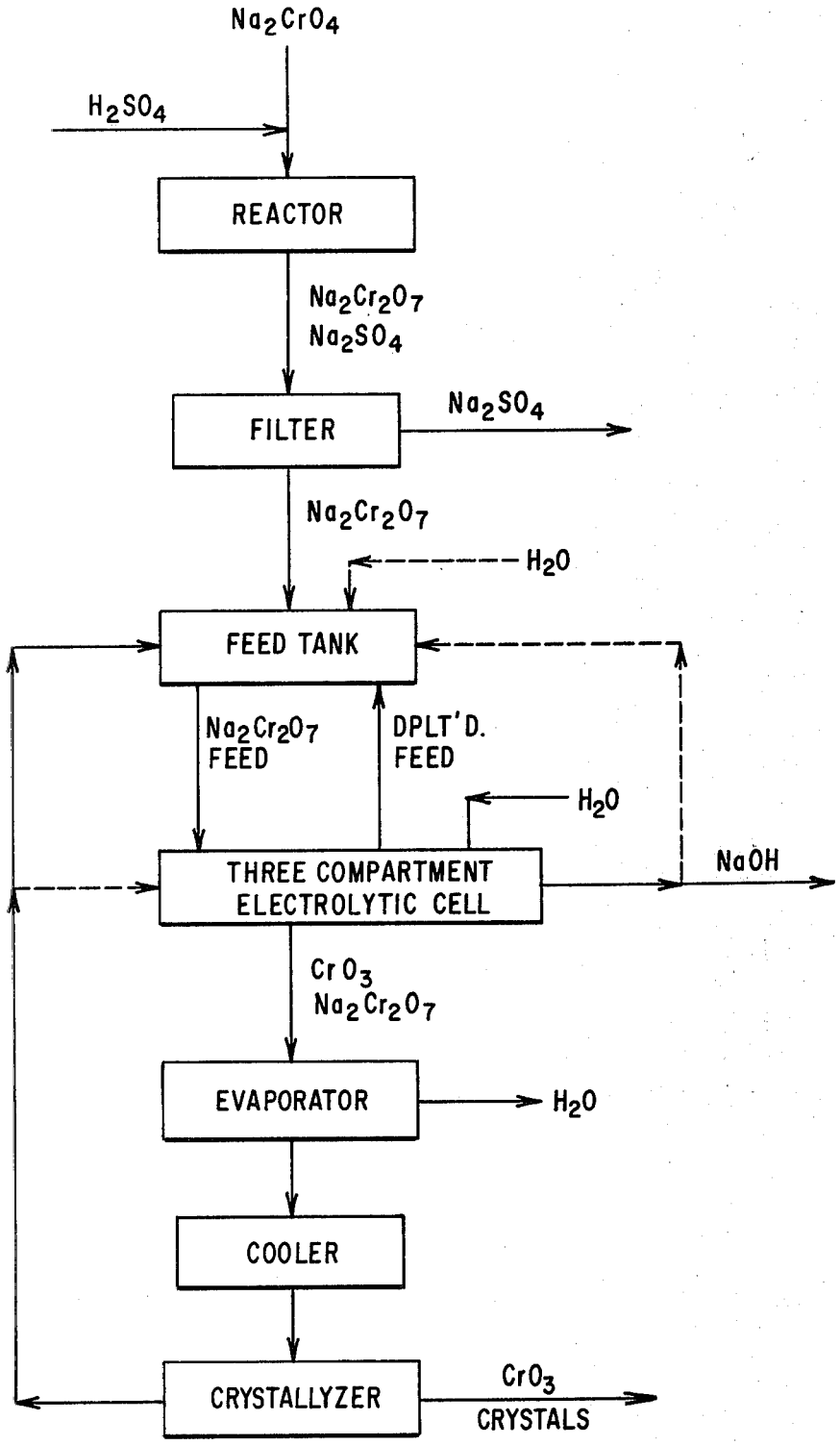
$Na_2CrO_4$
$H_2SO_4$
REACTOR
$Na_2Cr_2O_7$
$Na_2SO_4$
FILTER
$Na_2SO_4$
$Na_2Cr_2O_7$
$H_2O$
FEED TANK
$Na_2Cr_2O_7$
FEED
DPLT'D.
FEED
$H_2O$
THREE COMPARTMENT
ELECTROLYTIC CELL
NaOH
$CrO_3$
$Na_2Cr_2O_7$
EVAPORATOR
$H_2O$
COOLER
CRYSTALLYZER
$CrO_3$
CRYSTALS

CHROMIC ACID PRODUCTION PROCESS USING A THREE-COMPARTMENT CELL

CROSS-REFERENCE TO RELATED APPLICATION

This is a continuation-in-part of copending application Ser. No. 43,382, filed May 29, 1979, now abandoned.

BACKGROUND OF THE INVENTION

The alkali roasting of chrome ore will provide a product that when leached with water yields an aqueous alkaline solution containing alkali metal chromate. This solution can then be reacted with acid to yield the dichromate. Sulfuric is a useful acid and a process employing same has been taught in U.S. Pat. No. 2,612,435. Carbon dioxide is also useful, and a showing of its use has been made in U.S. Pat. No. 2,931,704.

It has not been unusual for the roasting of the ore to introduce chloride ions which contaminate the aqueous solution as sodium chloride. In order to remove this sodium chloride impurity, it has been taught in U.S. Pat. No. 3,454,478 that the major processing steps can be supplemented with a two-compartment electrolytic cell. This cell will be located along side the processing stream, and before the sodium dichromate crystallizer. The cell can be a small bleed stream that is electrolyzed, thereby removing the chloride as chlorine gas at the anode, and the dichromate liquor from the anode compartment of the cell is returned to the main process stream.

In U.S. Pat. No. 2,099,658, it has been disclosed to electrolytically produce chromic acid using a sacrificial anode. The process yields a contaminated product or requires an ostensibly cumbersome and inefficient stepwise procedure to achieve relatively impurity-free acid.

It has also been taught, as in Canadian Pat. No. 739,447, that sodium dichromate can be fed directly to the anode compartment of a two-compartment cell in the process of preparing chromic acid. The efficiency of such operation, however, has not proven satisfactory.

SUMMARY OF THE INVENTION

It has now been found that alkali metal dichromate can be effectively processed to prepare chromic acid, wherein the process uses an electrolytic cell having remarkably high current efficiency. The cell can be located in the mainstream of the invention process and accept as dichromate feed such substance as is available in commercial chromic acid production processes. Further, by careful selection of operation parameters, it has been found that coincident high concentration of both chromic acid anolyte product and catholyte alkali product can now be achieved. In doing so, the current efficiencies achieved rival those previously obtained in more conventional electrolytic cell operation such as for caustic and chlorine production with brine feed.

There is now further disclosed the most efficient utilization of alkali metal dichromate by recycling depleted cell feed and recycling of crystallization mother liquor for enhanced chromic acid production. The overall process provides for a reduction in processing equipment as well as a desirable reduction in by-product and by-product streams. Moreover, virtually chrome-free as well as concentrated alkali product is now achieved. Thus, a particular highlight of the process of the present invention is pollution reduction. And, this has been now coupled with a most desirably extended cell operation life.

In its broadest scope, the invention is involved in the production of chromic acid from chrome ore wherein the ore is roasted, solids are removed, and processing provides a solution containing alkali metal dichromate, and wherein intermediate dichromate solution, after further operation, is processed for chromic acid recovery, e.g., the solution is fed to an evaporator for chromic acid concentration and the concentrated and then cooled chromic acid solution is filtered. Within this broad scope, the invention involves the method of producing concentrated chromic acid from alkali metal dichromate while coincidentally producing virtually chrome-free, concentrated alkali product, all at enhanced current efficiency, which process comprises: (A) introducing to the center compartment of a three-compartment electrolytic cell, alkali metal dichromate at a concentration above about 900 grams per liter, such dichromate containing reduced forms of chromium, if such exist, at substantially below about 2 percent of the dichromate hexavalent chromium, the center compartment of the cell having porous diaphragm means separating same from an anode compartment, and further having substantially hydraulically impermeable cation-exchange membrane means separating the center compartment from a cathode compartment; (B) permitting center compartment dichromate-containing electrolyte flow through the porous diaphragm to the anode compartment; (C) introducing electrolyte to the cathode compartment; (D) applying electrolyzing current to the electrolytic cell at a density above about 2 amperes per square inch; (E) withdrawing from the cathode compartment electrolyzed catholyte solution having an alkali product concentration of above about 400 grams per liter and containing below about 2 p.p.m. chromium; and (F) withdrawing from the anode compartment anolyte solution containing above about 700 grams per liter of chromic acid. Thereby, concentrated anolyte chromic acid can be produced at a current efficiency above about 90 percent while, simultaneously, concentrated catholyte alkali product can be prepared at a current efficiency above about 60 percent.

A further aspect of the invention comprises: evaporating water from the chromic acid solution withdrawn from the anode compartment, thereby preparing concentrated chromic acid solution; cooling the concentrated chromic acid solution in cooling means; and, recovering chromic acid crystals, in crystal recovery means, from the cooled and concentrated chromic acid solution and recirculating dichromate-containing liquor from the crystal recovery means back for subsequent electrolysis. Another aspect of the invention include feeding dichromate solution to the cell from upstream operation separating alkali metal sulfate or alkali metal carbonate from dichromate solution. In a further aspect, the invention comprises establishing the presence of carbon dioxide in the cathode compartment of the cell thereby preparing carbonate product in the catholyte.

As used herein, the term "alkali product" refers to alkali metal hydroxide and/or carbonate product, any of which may be in solution. The term "carbonate product" refers to alkali metal carbonate and/or bicarbonate. It is contemplated that the alkali metal will most typically be sodium and/or potassium. Where "sodium" is mentioned herein, it is to be understood that "alkali metal" is contemplated; but, for overall economy, the sodium will be preferred. Also, as used herein, the term "solution" is contemplated to include a slurry and/or the supplemental addition of solid product where such would be apparent to those skilled in the art. For example, dichromate solution feeding to the center compartment of the electrolytic cell may be in slurry form. Also, this solution or slurry may be supplemented as, for example, to occasionally boost sodium dichromate concentration, with the addition of solid sodium dichromate.

DESCRIPTION OF THE DRAWING

The FIGURE is a flow sheet of one embodiment of a processing operation for preparing chromic acid wherein alkali metal chromate is introduced into the processing and whereby other methods of the present invention are employed.

DESCRIPTION OF THE PREFERRED EMBODIMENTS

In the process for preparing chromic acid in accordance with the present invention, a system can be used such as shown in the FIGURE. Referring to the FIGURE, an alkali metal chromate solution, which can already have been treated with sulphuric acid, is treated then with further quantities of sulphuric acid. Alteratively, carbonic acid could be the acid of choice. This treatment, in the reactor, provides the dichromate solution, e.g., red liquor, which is then filtered. In the filter, the sulphate salt cake, or the alkali metal carbonate in the case of carbonic acid, is removed and the dichromate liquor passed to the feed tank. Water may be added to the solution in the feed tank to adjust concentration. Also, the feed tank may be equipped, as with a heater, or refrigeration system, or vacuum means, or combinations thereof, e.g., to facilitate evaporation and consequent solution concentration in the tank, as such concentration will be most always maintained at above 900 grams per liter of dichromate.

From the feed tank, alkali metal dichromate feed is passed to the center compartment of a three-compartment electrolytic cell. The dichromate solution feeding to the cell will be at a temperature ranging from cooled condition below room temperature, e.g., on the order of 5° C. or even less, and ranging up to about boiling condition. Typically, the feed temperature is within the range from about 15° C. to about 95° C. It is contemplated that cool feed will be used under conditions where sufficient cell current density might otherwise lead to cell electrolyte reaching boiling condition. The feed will contain more than about 900 grams per liter, and advantageously above about 1000 grams per liter, of alkali metal dichromate for overall operating efficiency. For best efficiency, the feed will preferably contain alkali metal dichromate within the range from about 1200 to about 1600 grams per liter. Hence, with sodium dichromate as an example and a cell current density on the order of 3 asi, the feed solution temperature might typically be about 75°–90° C., and the weight percent of the sodium dichromate might be on the order of 70–90 weight percent. If reduced forms of chromium, e.g., trivalent chromium, are contained in the feed, i.e., if such exist in the feed, they should be present in an amount substantially below about 2 percent of the dichromate hexavalent chromium, which percentage is advantageously only a peak amount that is not sustained. The presence of reduced forms of chromium in the feed may lead to the formation of deleterious precipitates in the center compartment of the cell. Hence, if they exist in the feed at all, these reduced forms are advantageously present in an amount below about one percent of the dichromate hexavalent chromium. Preferably, for best ease of operation, the feed is free from reduced forms of chromium.

In typical cell operation, as will be discussed further hereinbelow, the feed to the center compartment will be substantially free from chromic acid. This assists in minimizing the presence of chromic acid in the center compartment. When no chromic acid is present in the center compartment electrolyte, the "anolyte ratio" of such compartment calculated for sodium dichromate is at 20.8 percent, and when calculated for potassium dichromate is at 31.95 percent. This ratio is defined as the alkali metal oxide concentration in the electrolyte divided by the sum of the electrolyte chromic acid concentration plus the alkali metal dichromate dihydrate concentration. The ratio is expressed as a percentage. All concentrations are in equivalent units, such as grams per liter, when calculating the ratio. For the case of sodium oxide, it is expressed as $Na_2O$.

In the cell, the center compartment solution flows through a porous diaphragm to an anode compartment. Referring again to the FIGURE, depleted solution from the center compartment can be returned to the feed tank. Aqueous electrolyte is introduced into the cathode compartment of the cell. Although it is contemplated that this electrolyte might be no more than simply tap water, it is preferably primed at the outset of cell operation for enhanced cell efficiency at start-up. Alkali metal hydroxide is suitable for priming. Thereafter, during electrolysis, the alkali product concentration of the catholyte may be at least partially controlled by water addition, or such addition to recirculating catholyte, not shown, or by the addition of such dilute aqueous solution as can be provided by introducing carbon dioxide to the catholyte feed. Alkali product will be removed from the cathode compartment during continuous electrolysis. Under the cell operation in accordance with the present invention, the alkali product concentration will be above about 400 grams per liter of catholyte effluent solution. Further, as is more particularly discussed hereinbelow, the product will be virtually chrome-free. Advantageously, for enhanced efficiency, the alkali product concentration will be within the range from about 500 to about 650 grams per liter. A portion of the alkali product removed from the cell may be circulated back to the feed tank for pH adjustment of the solution in the tank, or some may be recycled back for use in the chrome ore roasting process.

In cell operation electrolyzing sodium dichromate, although the anolyte ratio for the anolyte will be below 20.8 percent, for ease in subsequent chromic acid crystallization, it is preferable to continue electrolysis until the ratio, for the anolyte, reaches a percentage down to at least on the order of about 11–13 percent. For most efficient overall operations, the electrolysis will not provide a ratio for the anolyte extending below about 3 percent. During operation with sodium dichromate, at a current density of above about 2 asi, the anolyte ratio for the anolyte will generally be within the range from about 4 percent to 8 percent, and under these conditions, the anolyte current efficiency will be above about 90 percent and may reach about 95 percent or more. In the anolyte, the chromic acid concentration will be above about 700 grams per liter and advantageously will exceed 750 grams per liter. Preferably, for best efficiency in downstream chromic acid crystal recovery, the anolyte solution leaving the anode compartment will contain on the order of about 800–850 grams per liter of chromic acid, while the process is providing anolyte current efficiencies on the order of 90–95 percent.

From the anolyte compartment of the electrolytic cell, the chromic acid solution; containing some alkali metal dichromate, and being at an elevated temperature from about 40° C. to about boiling, passes to an evaporator, as will be seen by reference to the FIGURE. A conventional thin film evaporator, or a flash evaporator, or a multiple effect evaporator may be used, usually with heat application. The concentrated chromic acid is then cooled. Before cooling, the solution will generally be at a temperature within the range of from about 95° C. to about 150° C. under normal pressure, and the cooling operation will usually reduce the concentrated chromic acid solution to a temperature within the range from about 20° C. to about 60° C. The cooling means can be a cooling crystallizer, e.g., a stirred tank equipped with a cooling jacket. Therein, acid crystals form during cooling. On the basis of achieving a cooled solution having a temperature of about 25° C., the evaporator may remove up to about 85–95 weight percent of the solution water.

The cooled solution is then ready for crystal recovery. The crystal recovery means, e.g., a centrifuge, separates the chromic acid crystals from the mother liquor. This mother liquor, containing alkali metal dichromate and depleted of chromic acid, is then circulated back to the feed tank. In this case, recirculating alkali product can be used to facilitate pH adjustment of the feed tank contents, typically to a pH within the range of 3–5 and, preferably, of about 4, for augmenting the dichromate content of the tank. After the dichromate content is thus enhanced, i.e., acid content is reduced and may be eliminated, the recirculated mother liquor is then suitable for passing to the cell center compartment. Alternatively, the mother liquor, or a portion thereof, can be passed back to the anolyte compartment of the electrolytic cell, since this mother liquor will contain chromic acid. For best efficiency of operation, any chromic acid entering the cell, e.g., in recycled solution, will come into the anode compartment. Advantageously, for efficient cell operation, any feed to the center compartment will thus be substantially free from chromic acid, e.g., contain a few weight percent at most of chromic acid. Preferably, for best efficiency, this feed is free from chromic acid. It is contemplated that the evaporation, cooling and crystallization can all be effected in a vacuum crystallizer, with the mother liquor therefrom being recirculated as above-described.

The electrolytic cell used in the invention process may be a single cell or a plurality of cells combined together into a single electrolyzing unit either in series using bipolar electrodes or in parallel. Referring to a single cell unit, the cell will, preferably, achieve a pressure differential between the center compartment and the anode compartment to enhance the flow of center compartment liquid into the anode compartment. This differential can be obtained by pumping the feed through the center compartment or by maintaining a hydrostatic head of cell solution in the center compartment. Achieved pressure on the center compartment of about 0 psig and of up to about one psig has been found to be suitable, while such up to about 2 psig is contemplated. All electrolytes can be at essentially atmospheric pressure. By this, it is meant that no additional pressure is contemplated other than resulting from cell operation, such as might be associated with the hydrostatic pressure of the center compartment, or with the addition of carbon dioxide to the catholyte, or the like. The center compartment will also be equipped with an outlet for passing depleted center compartment solution out of the cell, although cell feed can also be kept in balance with the flow of center compartment solution through the porous diaphragm to the anode compartment. This solution flow provides fresh feed for the anolyte, and the solution sweeping into the anolyte will retard migration of hydrogen ions from the anode compartment.

The porous diaphragm may be constructed of any material compatible with the alkali metal dichromate and chromic acid environment of the cell and which will also permit bulk hydraulic flow from the center compartment to the anolyte, as well as having appropriate electrical conductivity characteristics. An example of such material is asbestos. Of particular interest are diaphragms produced from fluorocarbon polymers, e.g., poly(fluorocarbons) which are copolymers of fluorocarbons and fluorinated sulfonyl vinyl ethers. The diaphragm may be in the form of a porous sheet of the poly(fluorocarbon) copolymer, or in the form of a porous base member having at least a portion of its surface coated with the copolymer. Suitable base members include poly(fluorocarbons) and asbestos. The porous or poromeric sheets or coated base members will usually be in the form of sheets having a thickness of less than 0.25 inch to optimize cell efficiency. The typical porosity for such materials may range from 15 to 85 percent, but is, preferably, below about 40 percent to retard backflow of anolyte solution to the center compartment. Individual pores may have areas on the order of from $8\times10^{-13}$ square centimeters to about $8\times10^{-5}$ square centimeters per pore when measured by the method described in ASTM Standard 02499. A description of these particular membranes has been made in West German Patent Publication No. 2,243,866. Other suitable diaphragm materials include acid resistant filter paper, ceramic, polyethylene, chlorofluorocarbon, poly(fluorocarbon) and other synthetic fabrics so long as they provide a relatively low electrical resistance. In this regard, electrolysis will be carried out with direct current at a current density above about 2 up to about 5 amperes per square inch. A density within the range of greater than 2, up to 4, asi is preferred for best efficiency. The anode compartment will have, in addition to the product outlet, an outlet for removing oxygen gas evolved at the anode which may be in part mixed with trace amounts of impurity, e.g., gaseous halide impurity. It is contemplated that such impurity will be chlorine gas, as the cell feed may be contaminated with alkali metal chloride and the anode employed may be one, such as those formed from valve metals bearing a noble-metal-containing coating that are discussed hereinbelow, which facilitate chlorine gas evolution. The anode compartment may further be equipped with an inlet for admitting recycled solution, the entry of which to the anode compartment has been mentioned hereinabove.

The anode used in the electrolytic cell of the invention process may be any conventional, electrically-conductive, electrocatalytically active material resistant to the anolyte such as the lead alloy types used commercially in plating operations. Lead and lead alloy anodes are preferred. Other useful anodes include those that are formed from a valve metal such as titanium, tantalum or alloys thereof bearing on its surface a noble metal, a noble metal oxide (either alone or in combination with a valve metal oxide), or other electrocatalytically active, corrosion-resistant material. Anodes of this class are called dimensionally stable anodes and are well-known and widely used in industry. See, for example, U.S. Pat. Nos. 3,117,023, 3,632,498, 3,840,443 and 3,846,273. While solid anodes may be used, foraminous anodes having about 25 percent or more of their surface area open, such as an expanded mesh sheet, woven mesh screen, or perforated plate, are preferred since they have greater electrocatalytic surface area and facilitate the flow of fluids in the anolyte compartment, e.g., facilitate the removal of oxygen gas from the compartment. The anode can be in juxtaposition with the diaphragm or laminated to the diaphragm.

The center compartment will be separated from the cathode compartment by a membrane. The membrane may be, in general, any hydraulically impermeable cation-exchange membrane electrolytically conductive in the hydrated state obtaining under cell operating conditions and compatible with the environment. These membranes may comprise a film of a polymer, chemically resistant to the feed solution and catholyte. When such structure is present, the film will, preferably, contain hydrophylic, ion-exchange groups such as sulfonic groups, carboxylic groups and/or sulfonamide groups. Membranes made from polymers containing sulfonic and/or carboxylic groups have been found to have good selectivity (that is, they transport virtually only alkali metal ions) and low-voltage characteristics for the production of alkali metal hydroxide, or carbonate or bicarbonate, in the catholyte, while membranes containing sulfonamide groups may be useful in obtaining higher caustic current efficiencies, but require a somewhat higher electrolyzing voltage. Typically, these membrane polymers have an ion-exchange group equivalent weight of about 800–1500 and the capacity to absorb, on a dry basis, in excess of 5 weight percent gel water.

The cation of the ion-exchange group (representative groups being $$-CO_2H,\ -SO_3H,\ -SO_2N\begin{matrix}R\\H\end{matrix}$$

and the like) in the membrane will mostly be alkali metal, i.e., the same alkali metal as present in the cell feed. While the acid or other alkali metal salt form can be employed at start-up, it will be appreciated that the membrane will exchange virtually all of these cations for the cation of the alkali metal dichromate cell feed within a relatively short period of cell operation. Polymers having all of their hydrogens replaced with fluorine atoms or the majority with fluorine atoms and the balance with chlorine atoms, and having the ion-exchange groups attached to a carbon atom having at least one fluorine atom connected thereto, are preferred for maximum chemical resistance.

For efficient and extended cell operation, a particularly preferred membrane used in the process of the present invention is a thin film of fluorinated copolymer having pendant sulfonic acid groups. The fluorinated copolymer is derived from monomers of the formula $$FO_2S(R)_nCF=CF_2$$

in which the pendant $-SO_2F$ groups are converted to $-SO_3H$ groups, and which monomers are reacted with monomers of the formula $$CXX^1=CF_2.$$

In these formulas, R represents the group $$-\overset{\overset{R^1}{|}}{C}F-CF_2-O-(CFY-CF_2O)_m-$$

in which $R^1$ is fluorine, or perfluoroalkyl of 1-10 carbon atoms; Y is fluorine or trifluoromethyl; m is 1, 2, or 3; n is 0 or 1; X is fluorine, chlorine or trifluoromethyl; and $X^1$ is X or $CF_3(CF_2)_a$ wherein a is 0 or an integer from 1 to 5.

This results in copolymers for this particularly preferred membrane having the repeating structural units $$-\underset{\underset{\underset{SO_3H}{|}}{(R)_n}}{\overset{\overset{F}{|}}{C}}-CF_2- \quad \text{and} \quad -CXX^1-CF_2-$$

In the copolymer, there should be sufficient of the repeating units having $-SO_3H$ functionality to provide an $-SO_3H$ equivalent weight of about 1000 to 1400.

To minimize electrolyzing voltage, the membrane, preferably, has a thickness in the range of about 3 to 10 mils, with thicker membranes in this range being used for better durability. The membrane will typically be laminated to and impregnated into a hydraulically permeable, electrolytically nonconductive, inert reinforcing member such as a woven or nonwoven fabric made from fibers of asbestos, glass, poly(fluorocarbons) and the like. In filmfabric laminated membranes, it is preferred that the laminate have an unbroken surface of the film resin on both sides of the fabric to prevent leakage through the membrane caused by seepage along the fabric yarns. Such laminates and methods for their manufacture are disclosed in U.S. Pat. No. 3,770,567. Alternatively, films of the membrane polymer may be laminated to each side of the fabric.

Suitable membranes are available from the E. I. du-Pont de Nemours & Co. under the trademark NAFION. The preparation and description of suitable NAFION and other types of membranes is provided, among others, in British Pat. No. 1,184,321, German Patent Publication No. 1,941,847, U.S. Pat. Nos. 3,041,317, 3,282,875, 3,624,053, 3,784,399, 3,849,243, 3,909,378, 4,025,405, 4,080,270, and 4,101,395. By being "substantially hydraulically impermeable," as the term is used herein, these membranes under the broad ranges of cell operating conditions may be expected to afford virtually no transportation of cell electrolyte by direct flow through pores within the membrane structure.

The cathode used in the electrolysis cell of the invention process, may be any conventional electrically conductive material resistant to the catholyte, such as iron, mild steel, stainless steel, nickel, and the like. The cathode may be foraminous and gas permeable, e.g., having at least 25 percent of its surface area open, thereby facilitating the flow and removal of hydrogen gas in the catholyte compartment, and/or the circulation of carbon dioxide when such is introduced for production of carbonate or bicarbonate in the cathode chamber. To reduce the electrolyzing voltage, all or part of the surface of the cathode may bear a coating or layer of a material lowering the hydrogen overvoltage of the cathode, such as are disclosed in U.S. Pat. No. 4,024,044 (melt-sprayed and leached coating of particulate nickel and aluminum), U.S. Pat. No. 4,104,133 (electrodeposited coating of a nickel-zinc alloy), and U.S. Pat. No. 3,350,294 (coating of molybdenum and tungsten and cobalt, nickel or iron). Useful cathodes also include oxidizing gas depolarized cathodes. Such have been discussed, for example, in U.S. Pat. No. 4,121,992.

Suitable cathodes can be made from, for example, expanded mesh sheet, woven wire screen or perforated plates. The cathode may be a parallelplate electrode, although other elongated electrode elements having other crosssectional shapes, such as round, elipsoid, triangular, diamond, and square, can be utilized. The cathode can be in juxtaposition with the membrane or laminated to the membrane. Preferably, for best operating efficiency, nickel plated steel cathodes are used.

The cathode compartment will be provided with an electrolyte inlet for introducing an electrolyte thereto, such as water, preferably primed at cell start-up as discussed hereinabove. This can also serve as the water addition port during electrolysis. The compartment will possibly also have an inlet for introducing carbon dioxide to such cathode chamber, or carbon dioxide can be introduced to catholyte recirculating outside the cell, if the production of other than alkali metal hydroxide is desired. The cathode compartment will have a product outlet for the removal of catholyte solution, i.e., resulting alkali product, and an outlet for hydrogen gas escape. In cell operation, the movement of alkali metal ions into the cathode chamber will be desirably facilitated by the membrane, while the transport across the membrane of the hydroxyl ions of the catholyte and dichromate ions of the center compartment will be impeded. When the dichromate feed is contaminated with metallic ions, particularly those of calcium, magnesium and the heavy metals, the membrane can serve to scavange these ions from the center compartment solution, thereby enhancing the production of more purified alkali product. It is an especial feature of this invention that the alkali product will be a virtually chrome-free, high grade product, i.e., contain below about 2 p.p.m. of chromium. Advantageously, for desirable product quality, there will be below about 1 p.p.m. chromium, and preferably for best quality any chromium present in the alkali product will be on the order of about 0.5–0.2 p.p.m. or less.

Although incoming cell electrolytes can be cool, e.g., below room temperature, the cell will operate at elevated temperature, as up to about boiling. Elevated temperatures result in increased solution conductivity and, hence, lower cell voltages. Generally, the cell will be at a temperature above about 40° C. and, advantageously, will be at a temperature above about 60° C. Preferably, for most efficient conductivity, the cell electrolytes are at a temperature within the range from about 80° C. to about 95° C. In addition to the heat generated in the cell, or contributed by incoming solutions, the feed lines may be heated or a heater placed in the cell to provide additional heat input.

The following Examples 3 and 4 show ways in which the invention has been practiced, but should not be construed as limiting the invention. In the presentation hereinbelow, the Examples 1 and 2 are comparative and are not representative of the invention.

EXAMPLES 1–4

The electrolysis cell used in the examples was of sufficient size to accommodate electrodes of 3 square inches in projected frontal surface area. The cell had polytetrafluoroethylene gasketing between the center and cathode compartments, as well as between the center and anode compartments of the cell. Outlet vents were provided for passage of oxygen gas at the anode and hydrogen at the cathode.

The sodium dichromate feed stream was at a temperature of about 20° C. For the Examples 1 and 2 which are comparative and not representative of the present invention, it contained about 500–600 grams per liter (g/l) sodium dichromate plus a trace amount of sodium chloride impurity; and for the Examples 3 and 4 of the invention, it contained 1200 g/l sodium dichromate. The center compartment, sometimes called the feed compartment, was constructed of titanium.

The anode compartment of the electrolytic cell was constructed of glass and contained a circular anode having a surface area of 3 square inches. The anode used was an expanded mesh titanium metal anode bearing a tantalum oxide/iridium oxide coating. Such anodes have been disclosed in U.S. Pat. No. 3,878,083. The hydraulically permeable porous diaphragm separating the feed compartment from the anode compartment was an about 21 mils thick porous member of a perfluorosulfonic acid copolymer deposited on a polytetrafluoroethylene mesh substrate.

The cathode compartment was constructed of acrylic plastic. The cathode chamber contained an array of nickel parallel plate cathodes, designed to facilitate hydrogen gas release and provided a projected frontal surface area of 3 square inches. Separating this compartment and the feed compartment was a substantially hydraulically impermeable cation-exchange membrane. The membrane used was an about 14 mils thick film comprised of an integral layer of a copolymer laminated to a square-woven polytetrafluoroethylene fabric. The layer laminated to the fabric had a thickness of about 7 mils and comprised a copolymer having recurring units of:

$$-CF_2-CF_2-$$

and $$-CF_2-\underset{\underset{\displaystyle O-CF_2-\underset{\underset{\displaystyle CF_3}{|}}{CF}-O-CF_2-CF_2-SO_3H}{|}}{CF}-$$

and an equivalent weight of about 1100.

The cell temperature varied between about 85° C. to about 95° C., with supplemental heat being provided as needed by a heater in the anode compartment. A hydrostatic liquid head difference was maintained between the center and anode compartments. This created a pressure drop of less than 1 psig across the porous diaphragm and allowed bulk flow from the center to the anolyte compartment. The feed solution was entering the center compartment at a rate of approximately 3.5 milliliters/minute (ml/min). Into the cathode compartment distilled water at a temperature of about 20° C. was introduced at a rate sufficient to control the caustic strength of catholyte at between 150–400 g/l, for the Examples 1 and 2; but as shown in the table below, the achieved strength for the Examples 3 and 4 was much greater. Prior to the initiation of electrolysis, the compartment was primed with sodium hydroxide.

Depleted sodium dichromate solution was removed from a line at the top of the hydrostatic head of the center compartment. The flow rate for the depleted feed stream varied form 0 ml/min to 3.5 ml/min. From the vent line at the top of the anode chamber, oxygen gas, sometimes containing a trace of gaseous chlorine, was vented off. From the vent line at the cathode chamber, hydrogen was removed. Other process parameters and the results obtained are as shown in the table.

TABLE

| Examples: | Dichromate In Feed (g/l) | Current Density (asi) | Caustic In Catholyte Effluent (g/l) | Catholyte Current Eff. % | Chromic Acid In Anolyte Effluent (g/l) | Anolyte Current Eff. % |
|---|---|---|---|---|---|---|
| Comparative | | | | | | |
| 1 | ≦600 | 2 | ≦400+ | 63* | ≦600 | 66.2 |
| 2 | ≦600 | 3 | ≦400+ | 50.2 | ≦600 | 55.0 |
| Present Invention | | | | | | |
| 3 | 1200 | 2 | ≧600++ | ≧65 | >800 | 95.0 |
| 4 | 1200 | 3 | 540** | &3 | >800 | 94.0 |

*$CO_2$ catholyte addition used.
+Contains ≧2 p.p.m. chrome.
++Contains <2 p.p.m. chrome.
**Contains 0.2 p.p.m. chrome.

The reported anolyte and catholyte efficiencies are regarded as correct within a margin of about ±1 or 2 percent. For the cell, there is a center compartment efficiency. It can be an acid or base efficiency, in accordance with the center compartment deviation (to acidic or basic, during electrolysis), from the pH of the incoming sodium dichromate feed stream, and which deviation is due to acid or base migration from the anolyte or catholyte compartments respectively.

In these tests, the production of water white caustic, i.e., caustic visually free from caustic contamination, was readily produced in Examples 3 and 4, but the caustic of Examples 1 and 2 had a greenish or greenish yellow hue that was evidence of chrome contamination.

In leaving the cathode compartment, the caustic catholyte in all examples was withdrawn at a rate of about 0.3–0.5 ml/min. From the anolyte chamber, at a rate of 0.4–0.7 ml/min and a temperature of about 80° C., electrolyzed solution containing about 800–850 g/l chromic acid was withdrawn in Examples 3 and 4 and introduced to an evaporator.

The evaporator was a round bottom flask equipped with a heating mantel and overhead condenser. The contents of the evaporator were slowly heated to a temperature of about 140° C. thereby providing a chromic acid concentration of about 57–62 percent, by weight. For cooling, the concentrated chromic acid was maintained in the flask and permitted to air cool to about 25° C. The water from the evaporator was removed from the system. Chromic acid crystallization was initiated in the flask.

The cooled and concentrated chromic acid mixture was then introduced to a solid-liquid separator. This was a basket centrifuge with a 5 inch diameter titanium basket and a glass cloth filter blanket, and it was operated at about 6100 rpm. The chromic acid crystals, having a $CrO_3$ content of about 97.5–98 weight percent, were then removed from the crystallizer for further treatment. The liquor removed from the crystallizer, having about 34 weight percent chromic acid content, was removed from the system.

What is claimed is:

1. The method of producing concentrated chromic acid from alkali metal dichromate while coincidentally producing virtually chrome-free, concentrated alkali product, all at enhanced current efficiency, which process comprises:

(A) introducing to the center compartment of a three-compartment electrolytic cell, alkali metal dichromate at a concentration above about 900 grams per liter, said dichromate containing reduced forms of chromium, if such exist, at substantially below about 2 percent of the dichromate hexavalent chromium, the center compartment of said cell having porous diaphragm means separating same from an anode compartment, and further having substantially hydraulically impermeable cation-exchange membrane means separating the center compartment from a cathode compartment;

(B) permitting center compartment dichromate-containing electrolyte flow through said porous diaphragm to said anode compartment;

(C) introducing electrolyte to said cathode compartment;

(D) applying electrolyzing current to said electrolytic cell at a density above about 2 amperes per square inch;

(E) withdrawing from said cathode compartment electrolyzed catholyte solution having an alkali product concentration of above about 400 grams per liter and containing below about 2 p.p.m. chromium; and (F) withdrawing from said anode compartment anolyte solution containing above about 700 grams per liter of chromic acid; whereby concentrated anolyte chromic acid can be produced at a current efficiency above about 90 percent while, simultaneously, concentrated catholyte alkali product can be prepared at a current efficiency above about 60 percent.

2. The process of claim 1 wherein said electrolyzing current is a direct electrolyzing current applied across the anode and cathode of the cell and in the electrolyzing, halide impurity when present in the dichromate solution, is reduced with commensurate evolution of halogen at the anode.

3. The process of claim 1 wherein said electrolyzing current provides a current density of above about 2 to about 5 amperes per square inch.

4. The process of claim 1 further characterized by introducing carbon dioxide into catholyte in the cell or into catholyte being recirculated outside the cell, thereby preparing carbonate product in the catholyte, and the carbonate product is removed from said cathode compartment or from recirculating catholyte.

5. The process of claim 1 wherein said catholyte solution withdrawn from said cathode compartment in step (E) has an alkali product concentration within the range from about 500 to about 650 grams per liter and contains below about 1 p.p.m. chromium.

6. The process of claim 1 wherein electrolyzed catholyte solution leaving said cathode compartment in step (E) is at a temperature within the range from about 40° C. to about 95° C.

7. The process of claim 1 wherein the alkali product concentration in said cathode compartment is at least partially controlled during electrolysis by water addition thereto or by water addition to catholyte being recirculated outside said cell.

8. The process of claim 1 wherein said alkali metal dichromate introduced to the cell in step (A) is substantially free from chromic acid and is at a concentration within the range from about 1200 to about 1600 grams per liter of said dichromate.

9. The process of claim 1 wherein said alkali metal dichromate solution feeding to the cell in step (A) is at a temperature ranging from cooled condition below room temperature up to about boiling condition.

10. The process of claim 1 wherein said alkali metal dichromate solution feeding to the cell in step (A) is at a temperature within the range of from about 5° C. to about 95° C. and a pressure differential enhances electrolyte flow in step (B) from said center compartment through said porous diaphragm.

11. The process of claim 10 wherein a hydrostatic head of pressure is present on said dichromate-containing electrolyte, and said pressure is maintained within the range from about 0 psig to about 2 psig.

12. The process of claim 1 further characterized by withdrawing solution, depleted in alkali metal dichromate, from said center compartment and recycling same for combination with dichromate feed introduced in step (A).

13. The process of claim 1 further characterized by maintaining in said anode compartment aqueous potassium-dichromate-containing anolyte having an anolyte ratio below 31.95 percent.

14. The process of claim 1 wherein said anolyte solution withdrawn from said anode compartment in step (F) has a chromic acid concentration within the range from about 750 to about 850 grams per liter and is at a temperature within the range from about 40° C. to about boiling.

15. The process of claim 1 further characterized by maintaining in said anode compartment aqueous sodium-dichromate-containing anolyte having an anolyte ratio between about 3 and 20.8 percent.

16. The process of claim 1 wherein the substantially hydraulically impermeable, cation-exchange membrane comprises a film of a copolymer having the repeating structual units of the formula:

(I) 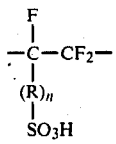 and (II) $-CXX^1-CF_2-$ wherein R represents the group

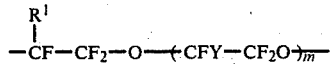

in which $R^1$ is fluorine, or perfluoralkyl of 1 to 10 carbon atoms; Y is fluorine or trifluoromethyl; m is 1,2 or 3; n is 0 or 1; X is fluorine, chlorine, or trifluoromethyl; and $X^1$ is X or $CF_3-(CF_2)_a-$ wherein a is 0 or an integer from 1 to 5; the units of formula (I) being present in an amount to provide a copolymer having an $-SO_3H$ equivalent weight of about 1000 to 1400.

17. The method of producing concentrated chromic acid from alkali metal dichromate while coincidentally producing virtually chrome-free, concentrated alkali product, all at enhanced current efficiency, which process comprises:

(A) introducing to the center compartment of a three-compartment electrolytic cell, alkali metal dichromate at a concentration above about 900 grams per liter, said dichromate containing reduced forms of chromium, if such exist, at substantially below about 2 percent of the dichromate hexavalent chromium, the center compartment of said cell having porous diaphragm means separating same from an anode compartment, and further having substantially hydraulically impermeable cation-exchange membrane means separating the center compartment from a cathode compartment;

(B) maintaining in said center compartment, under hydrostatic pressure maintained within the range from above 0 psig to about 2 psig and at elevated temperature of up to about boiling condition, an alkali metal dichromate solution at a concentration above about 900 grams per liter;

(C) permitting center compartment dichromate-containing electrolyte flow through said porous diaphragm to said anode compartment;

(D) introducing electrolyte to said cathode compartment;

(E) applying electrolyzing current to said electrolytic cell at a density above about 2 amperes per square inch;

(F) withdrawing from said cathode compartment electrolyzed catholyte solution having an alkali product concentration of above about 400 grams per liter and containing below about 2 p.p.m. chromium; and (G) maintaining in said anode compartment aqueous anolyte solution containing above about 700 grams per liter of chromic acid; while (H) withdrawing said electrolyzed chromic-acid-containing anolyte solution from said anode compartment and passing same to downstream chromic acid recovery means.

18. The method of producing concentrated chromic acid from alkali metal dichromate while coincidentally producing virtually chrome-free, concentrated alkali product, all at enhanced current efficiency, which process comprises:

(A) introducing to the center compartment of a three-compartment electrolytic cell, alkali metal dichromate at a concentration above about 900 grams per liter, said dichromate containing reduced forms of chromium if such exist, at substantially below about 2 percent of the dichromate hexavalent chromium, the center compartment of said cell having porous diaphragm means separating same from an anode compartment, and further having substantially hydraulically impermeable cation-exchange membrane means separating the center compartment from a cathode compartment;

(B) permitting center compartment dichromate-containing electrolyte flow through said porous diaphragm to said anode compartment;

(C) introducing electrolyte to said cathode compartment;

(D) applying electrolyzing current to said electrolytic cell at a density above about 2 amperes per square inch;

(E) withdrawing from said cathode compartment electrolyzed catholyte solution having an alkali product concentration of above about 400 grams per liter and containing below about 2 p.p.m. chromium; and (F) withdrawing from said anode compartment anolyte solution containing above about 700 grams per liter of chromic acid and passing same to evaporator means;

(G) evaporating water from the chromic acid solution, thereby preparing concentrated chromic acid solution;

(H) cooling the concentrated chromic acid solution in cooling means; and (I) recovering chromic acid crystals, in crystal recovery means, from the cooled and concentrated chromic acid solution and recirculating dichromate-containing liquor from said crystal recovery means back for subsequent electrolysis.

19. The process of claim 18 wherein said electrolyzing current is a direct electrolyzing current applied across the anode and cathode of the cell and, in the electrolyzing, halide impurity when present in the dichromate is reduced with commensurate evolution of halogen at the anode.

20. The process of claim 18 wherein said electrolyzing current provides a current density of above about 2 to about 5 amperes per square inch.

21. The process of claim 18 further characterized by introducing carbon dioxide into catholyte in the cell or into catholyte being recirculated outside the cell, thereby preparing carbonate product in the catholyte, and the carbonate product is removed from said cathode compartment or from recirculating catholyte.

22. The process of claim 18 wherein the alkali product concentration in said cathode compartment is at least partially controlled during electrolysis by water addition thereto or by water addition to catholyte being recirculated outside said cell.

23. The process of claim 18 wherein said catholyte solution withdrawn from said cathode compartment in step (E) has an alkali product concentration within the range from about 500 to about 650 grams per liter and contains below about 1 p.p.m. chromium.

24. The process of claim 18 wherein electrolyzed catholyte solution leaving said cathode compartment in step (E) is at a temperature within the range from about 40° C. to about 95° C.

25. The process of claim 18 wherein said alkali metal dichromate introduced to the cell in step (A) is substantially free from chromic acid and is at a concentration within the range from about 1200 to about 1600 grams per liter of said dichromate.

26. The process of claim 18 wherein said alkali metal dichromate solution feeding to the cell in step (A) is at a temperature ranging from cooled condition below room temperature up to about boiling condition.

27. The process of claim 18 wherein said alkali metal dichromate introduced to the cell in step (A) is at a temperature within the range of from about 5° C. to about 95° C. and a pressure differential enhances dichromate-containing electrolyte flow in step (B) from said center compartment through said porous diaphragm.

28. The process of claim 18 further characterized by withdrawing solution, depleted in alkali metal dichromate, from said center compartment and recycling same for combination with dichromate feed introduced in step (A).

29. The process of claim 18 wherein at least a portion of said recirculating dichromate-containing liquor from step (I) is fed to the anode compartment of said electrolytic cell.

30. The process of claim 18 further characterized by maintaining in said anode compartment aqueous sodium-dichromate-containing anolyte having an anolyte ratio between about 3 and 20.8 percent.

31. The process of claim 18 further characterized by maintaining in said anode compartment a potassium-dichromate-containing electrolyte having an anolyte ratio below 31.95 percent.

32. The process of claim 18 wherein said concentrated chromic acid solution in step (G) is at a temperature within the range from about 95° C. to about 150° C. and said concentrated chromic acid solution is thereafter cooled in step (H) to a temperature within the range from about 20° C. to about 60° C.

33. The process of claim 18 wherein chromic acid crystals are recovered in step (I) from said chromic acid solution by centrifuging said solution.

34. The process of claim 18 wherein the substantially hydraulically impermeable, cation-exchange membrane comprises a film of a copolymer having the repeating structural units of the formula:

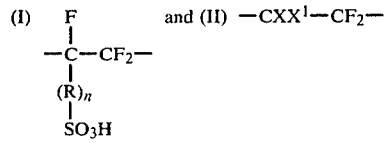

wherein R represents the group

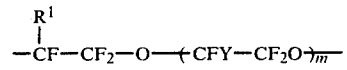

in which $R^1$ is fluorine, or perfluoralkyl of 1 to 10 carbon atoms; Y is fluorine or trifluoromethyl; m is 1, 2 or 3; n is 0 or 1; X is fluorine, chlorine, or trifluoromethyl; and $X^1$ is X or $CF_3$-$(CF_2)_a$ wherein a is 0 or an integer from 1 to 5; the units of formula (I) being present in an amount to provide a copolymer having an $-SO_3H$ equivalent weight of about 1000 to 1400.

* * * * *